United States Patent [19]

Dey et al.

[11] 4,161,014

[45] Jul. 10, 1979

[54] LUMINAIRE HAVING A CONFIGURED INTERFERENCE MIRROR AND REFLECTOR

[75] Inventors: Thomas W. Dey, Rochester, N.Y.; James D. Howe, St. Louis, Mo.; Eugene C. Letter, Rochester, N.Y.

[73] Assignee: Bausch & Lomb Incorporated, Rochester, N.Y.

[21] Appl. No.: 821,044

[22] Filed: Aug. 1, 1977

Related U.S. Application Data

[63] Continuation-in-part of Ser. No. 786,710, Apr. 11, 1977, abandoned, and a continuation-in-part of Ser. No. 716,415, Aug. 23, 1976, abandoned.

[51] Int. Cl.[2] ..... F21L 00/00; F21M 3/04

[52] U.S. Cl. ..... 362/263; 362/293; 362/333

[58] Field of Search ..... 362/217, 223, 293, 303, 362/355, 263, 300, 307, 311, 333; 350/163, 164, 165, 166

[56] References Cited

U.S. PATENT DOCUMENTS

| | | | |
|---|---|---|---|
| 2,017,716 | 10/1935 | Halvorson | 362/217 |
| 2,913,575 | 11/1959 | Lipscomb | 362/223 |
| 3,069,974 | 12/1962 | Marks et al. | 362/19 |
| 3,115,309 | 12/1963 | Spencer et al. | 362/217 |
| 3,124,639 | 4/1964 | Kahn | 362/19 |
| 3,188,513 | 6/1965 | Hausler | 362/293 X |
| 3,247,609 | 4/1966 | Hayes et al. | 350/166 |
| 3,329,812 | 7/1967 | Harling | 362/223 |
| 3,588,245 | 6/1971 | Herriott et al. | 350/166 X |
| 3,612,655 | 10/1971 | Buchan et al. | 350/163 X |
| 4,053,766 | 10/1977 | Brass | 362/301 |

*Primary Examiner*—William M. Shoop
*Assistant Examiner*—Peter S. Wong
*Attorney, Agent, or Firm*—Frank C. Parker; Bernard D. Bogdon

[57] ABSTRACT

A luminaire useful in illuminating a task area and having particular application for roadway lighting includes a monochromatic light source which is preferably a low pressure sodium lamp which can be an elongated tubular light source disposed within a housing defined by a reflector having a configured reflection surface to principally control light distribution along the length of the roadway with the lamp being at least partially surrounded and in a specific embodiment totally surrounded by a cylindrical tube acting as a substrate for a multilayer interference mirror to principally control light distribution across or transverse to the roadway. This combination of elements, in particular cooperation with their specific configurations, provides a predetermined light pattern on a task surface such as the example roadway.

38 Claims, 29 Drawing Figures

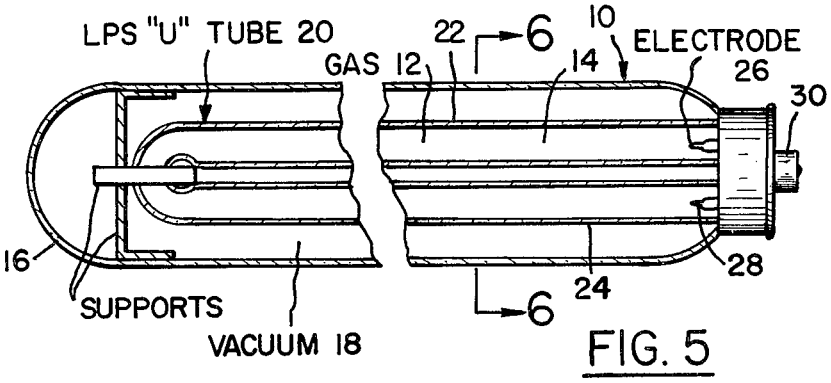
FIG. 5
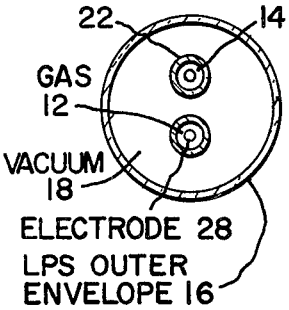
FIG. 6
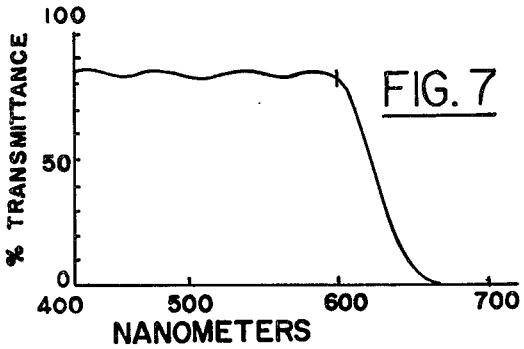
FIG. 7
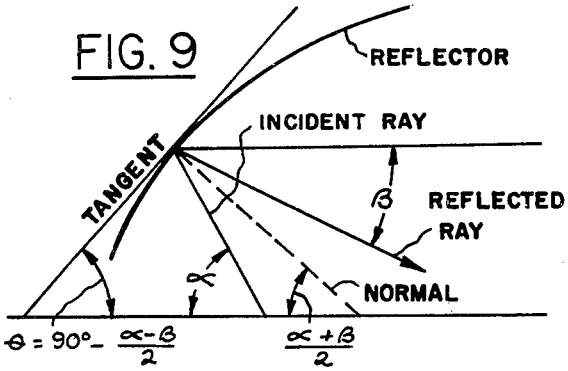
FIG. 9
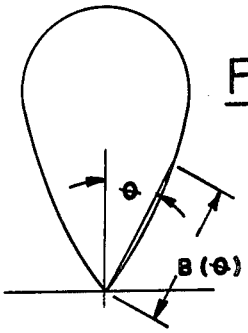
FIG. 8
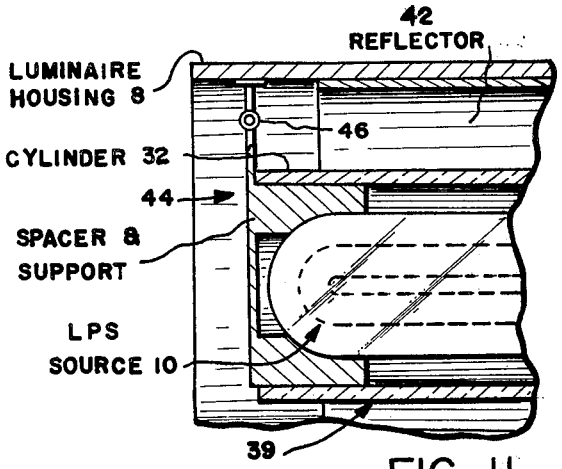
FIG. 11
FIG. 10
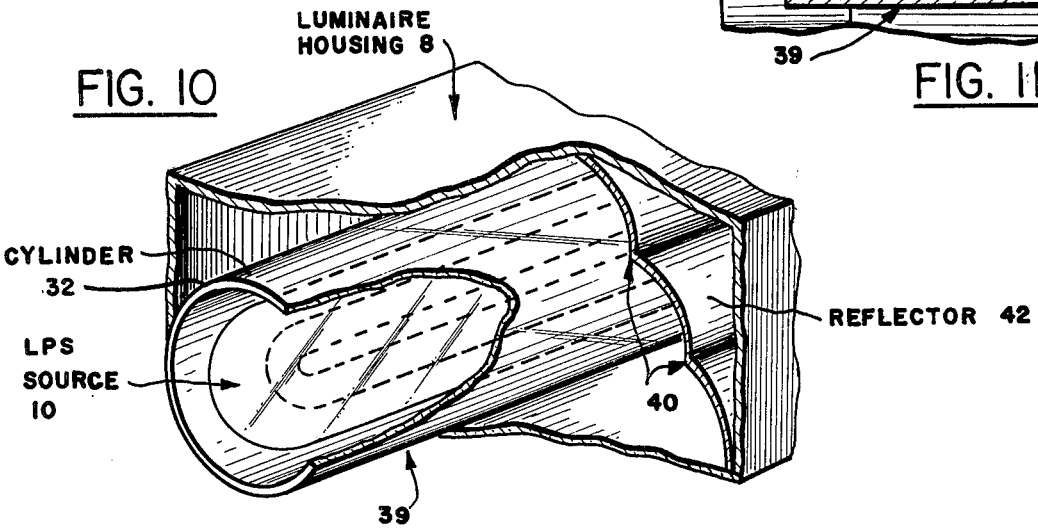

FIG. 12
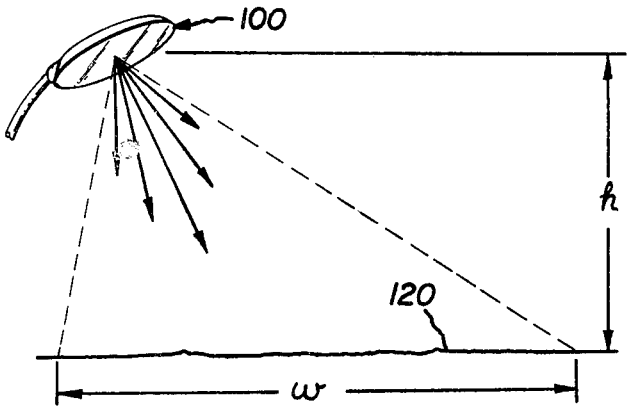
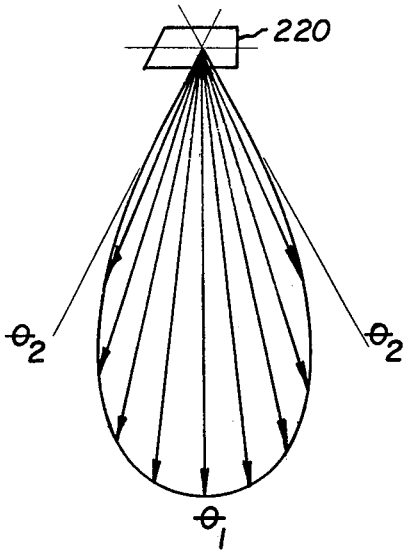
FIG. 15
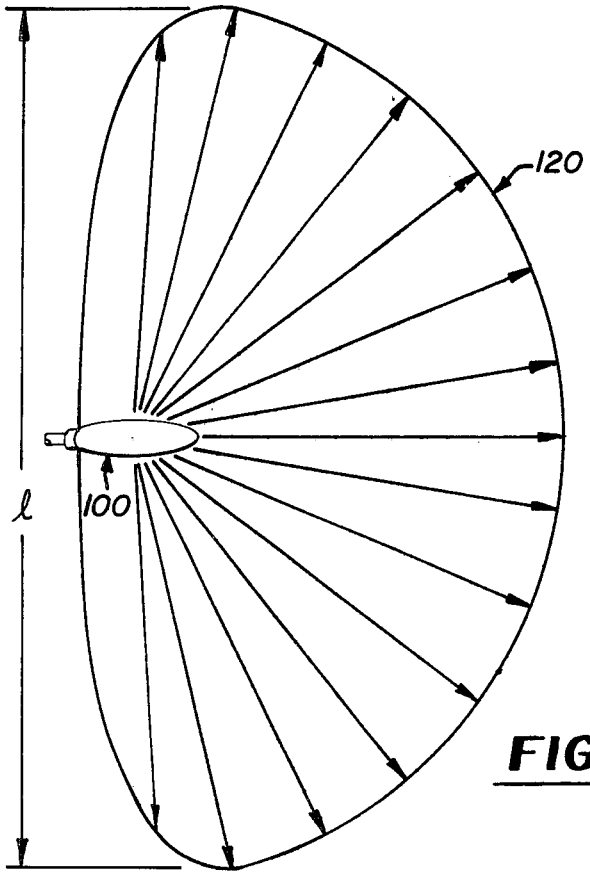
FIG. 14
FIG. 13
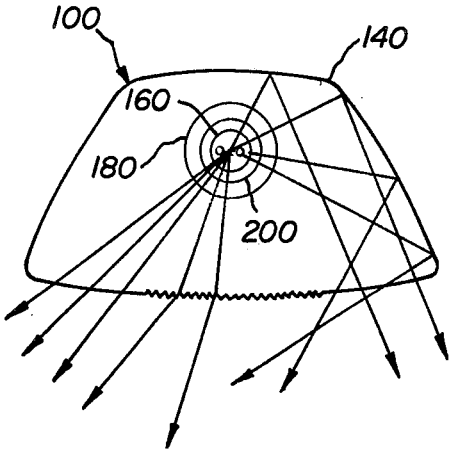

LUMINAIRE HAVING A CONFIGURED INTERFERENCE MIRROR AND REFLECTOR

CROSS-REFERENCES TO RELATED APPLICATIONS

This disclosure is a continuation-in-part of U.S. Pat. application Ser. No. 716,415 filed Aug. 23, 1976 entitled "Task Area Luminaire", now abandoned, and U.S. Pat. application Ser. No. 786,710 filed Apr. 11, 1977 entitled "A Luminaire Having A Configured Interference Mirror And Reflector", now abandoned, both having the same assignee and inventors which are common to the present disclosure. This patent application corresponds and is related to commonly assigned and concurrently filed copending patent application disclosure entitled "A Luminaire Using A Multilayer Interference Mirror", U.S. Pat. application Ser. No. 821,129 for inventors T. Dey and E. Letter, which application is a continuation-in-part of U.S. Pat. application Ser. No. 716,409 filed Aug. 23, 1976, now abandoned.

BACKGROUND OF THE INVENTION

1. Field of the Invention

The present invention is directed toward a luminaire and particularly to a luminaire fixture carrying a monochromatic light source disposed before a reflector for transmitting light through a configured multilayer interference mirror to produce a controlled light pattern.

2. Description of Other Art

Over the past few years, designers in the lighting industry have become concerned over the amount of energy used in a luminaire to provide a required amount of light. The amount of light required for any particular use has been generally set forth in the Illuminating Engineering Society (IES) Lighting Handbook, Fifth Edition, 1972. One particular use is the illumination of relatively even surfaces, as in roadway lighting and parking area lighting. It is important in illuminating these areas that sufficient illumination be provided to aid in preventing accidents and crime and in providing convenience and comfort.

Recently, however, designers in the lighting industry have become increasingly aware of conserving energy in the field of outdoor lighting. Luminaires that fulfill the lighting requirements of the IES are becoming unmarketable because of the expensive energy demands of the luminaires. At least one designer has approached this problem by suggesting a change in the light source used in the luminaire to "lend themselves to sophisticated reflector/refractor optical systems" *Lighting Design & Application,* "HPS and LPS—a primer", Terry K. McGowan, pp. 19–23, December, 1974. This designer states that lighting from luminaires with low pressure sodium (LPS) lamps is less efficient than lighting from luminaires with high pressure sodium (HPS) lamps because too much light emitted from the luminaires with LPS lamps misses or is misdirected to other than the task area. Accordingly, even though LPS lamps may under controlled circumstances be considered to have greater efficiency than HPS lamps, luminaires with HPS lamps are used because of a greater control over the light distribution pattern.

In before mentioned U.S. Pat. Application Entitled "A Luminaire Using a Multilayer Interference Mirror", Ser. No. 821,129 for inventors T. W. Dry and E. C. Letter which is a continuation-in-part of Ser. No. 716,409, there is described a luminaire incorporating the use of a directionally sensitive interference coating to achieve the directional control of monochromatic light in a luminaire by utilizing such a coating in cooperation with established conventional configured components of luminaires representative of the state of the art.

A luminaire is considered to be a lighting fixture used either for roadway lighting or for interior or exterior lighting. A luminaire assembly includes a monochromatic light source. Monochromatic light sources generally are defined as sources which emit luminous flux 75% of which falls within a bandwidth of 40 nanometers. Such monochromatic light sources include low pressure sodium lamps, light emitting diodes, neon lamps and lasers.

In the invention of the aforementioned patent continuation-in-part application Ser. No. 821,129, there is described a coating which predominantly transmits the light which is incident within a certain range of angles, and predominantly reflects light incident outside of that range. The luminaire proposed by that invention is comprised of a monochromatic source, which is preferably a low pressure sodium (LPS) lamp, diffuse reflector and a coated plate. The coating is selected to predominantly transmit light rays incident between 25° and 60° to essentially 90°, depending upon the efficiency application. These rays escape the luminaire and pass into the predetermined range characteristic of the coating.

Such a luminaire will distribute light from a large monochromatic source, such as an LPS lamp into, for example, a "radial batwing" considered desirable principally for the illumination of large planar areas such as parking lots, warehouses, parks and recreational fields. Such a pattern results in the illumination of the largest possible area with relative uniformity and minimum glare.

The directional sensitivity principle has been further developed in order to be more useful in roadway lighting. Because of its exceedingly superior light production as compared with other light sources, the LPS source is a desirable element for roadway lighting where very large areas must be illuminated at minimum energy consumption. Although superior, the large size of the LPS source, necessary for providing sufficient illumination, has made luminaire design difficult. Luminaires with LPS lamps, using classical reflection and refraction to control the light distribution, inherently allow far too much light to miss the roadway or target illuminated area. Some light falls to the near and far side of the roadway and some even leaves the luminaire in an upward direction, causing glare and loss of light. As a result, such luminaires have a low coefficient of utilization. The coefficient of utilization is a standard term adopted by the Illuminating Engineering Society to denote the proportion of light which falls onto the desired task area. The term is defined in the IES Lighting Handbook, Fifth Edition, 1972, as the ratio of the luminous flux (lumens) from a luminaire received on the work plane to the lumens emitted by the luminaire's lamps alone. To date, the low coefficient of utilization of LPS luminaires for roadway lighting has prevented such a potentially useful source from being acceptable for use within a roadway luminaire in the United States and some other countries.

SUMMARY OF THE INVENTION

It has been found that appropriate use of directionally sensitive interference films in cooperation with structure of unique and practical design overcomes the above stated difficulties, and allows use of an LPS source to provide a more efficient luminaire particularly suitable for roadway applications. It should be noted, as described in the beforementioned patent application Ser. No. 821,129, that the invention, as illustrated by the preferred embodiment, will not perform satisfactorily as a roadway luminaire. This is because the "radial batwing" lighting pattern resulting only from the mirror for selectively reflecting and transmitting light as a function of wavelength and angle of incidence in cooperation with the illustrated conventional luminaire configuration is not desirable for roadway illumination. Rather, it is desirable that a directional beam luminaire be provided which sends light predominantly up and down the length of the roadway. The position, size and shape of the illumination beams is dependent upon the roadway width, luminaire mounting height, and spacing between luminaires along the roadway. The Illuminating Engineering Society has developed a system for specifying roadway luminaires which is based upon their beam characteristics. Conventional low pressure sodium roadway luminaires are restricted in their form and are generally not configured to act as devices for providing illumination patterns which are most desirable. The presently disclosed unconventional application of directionally sensitive films in cooperation with unique luminaire geometry presents the advancement in the state of the art to low pressure sodium luminaires to such desirable light patterns providing relatively high coefficients of utilization.

In order to provide satisfactory roadway illumination directional beam characteristics, preferable coatings, different and modified from those most desirable for application to embodiments according to the principles of the invention and the units illustrated in the beforementioned patent application, are necessary. A coating, which transmits rays predominantly in a direction perpendicular to the coated surface, is what is contemplated, substantially all other rays being reflected. Suitable coatings include, for example, Bausch & Lomb Coating No. 90-1-620 as defined in FIG. 7, and these coatings are described in the following specification. This exemplary coating transmits 80% or more of the light incident at angles at or below 23° to the perpendicular and reflects 80% or more of the light at or above 35°. Thus, even though light may be incident upon the coating from a great many directions, only a well controlled directional beam emerges.

A twin-beam pattern useful for roadway lighting is generated by an appropriate combination of coated mirror plates, source and reflectors. One such device includes two diffuse reflectors opposing two directionally sensitive plates. The light from the source illuminates the plates both directly, and by reflection from the diffuse reflectors. The described configuration generates a twin-beam pattern useful in roadway lighting. The directional characteristic of the plate transmittance assures that the light which leaves the luminaire will fall within the directional beams aligned with the roadway. The twin-beam pattern configuration may be further modified to meet specific requirements by further alteration of the shape, size and orientation of the reflector and plates. Also, the reflector may be made specular to further shape the beam.

An embodiment contemplated by this invention which promises to have a very high efficiency with good control is one which uses the above-described coating to control the light only in one dimension, for example, in a direction transverse to a roadway. This inclusion of such a coating is used to keep the light from spilling over the near or far side of the roadway. In the alternative, the twin-beam effect is achieved by use of a specially designed specular reflector.

In order to limit the coating's effect to one dimension, the coating is disposed in a preferred embodiment in a cylindrical position about the long, relatively thin sodium source. As will be appreciated from contemplation of a view cross sectional to the axis of the lamp, all rays from the light source which approach the coating perpendicularly are allowed to pass and the coating has no effect. As seen from the side of the lamp, the coating restricts the light to a directional pattern. The light output pattern is thus controlled in one dimension, e.g. in a direction transverse to the roadway, by the coated cylinder. Control of the light in the other dimension is maintained by disposing the light source and cylinder combination within a specular reflector. Such a reflector is of a design to coordinate with the coating to achieve the desired results useful in roadway lighting. It is anticipated that the coated cylinder can be added to currently used LPS roadway luminaires and result in an improvement of the coefficient of utilization. The reflector can also be designed to be specifically compatible with the coated cylinder and to accept light generated by the cylinder's directional properties and distribute it into the twin-beam pattern along the roadway.

As with most roadway luminaires, an aperture or window is desirable in order to protect the source from the environment. This window may contain refraction devices to further modify the light output pattern.

This advancement of the state of the art, including the extension of the directionally sensitive coating to include coated surfaces which are other than the collective arrangement of being singular and planar and parallel to the task surface, is particularly significant, especially for roadway lighting. Of such significance, is the particular contribution of a cylindrical coating incorporated, for example, by use of a tube to control the light in one dimension only. It is significant since more light passes through the coating and less is reflected. This increases the efficiency of the luminaire. Such a specific embodiment is designed to provide illumination of a task area by using monochromatic light emitted from an elongated tubular light source element. A reflector element is operably disposed about the light source element to reflect the monochromatic light onto the task area. An elongated tubular multilayer light interference mirror element is operably disposed on a substrate about the light source and controls the distribution of emitted light into a control range.

The efficiency of the source and cylindrical coating combination may be further enhanced by positioning the source accurately on the axis of the cylinder. In this way, light which is reflected from the coating will return to the source, scatter, and be re-emitted in generally more desirable directions, to eventually exit the cylinder within the controlled range. Alternately, the source may be surrounded by a diffuse material. In this case, the reflected rays scatter at the diffuse material into directions which will allow them to exit the cylinder within the controlled range. The beforementioned coated cylinder and scattering cylinder may be formed upon added substrates such as glass or plastic or may be incorporated into or on one or both sides of the envelope of commercially available low pressure sodium sources.

The low energy consumption of luminaire fixtures utilizing low pressure sodium lamps is a significant factor when considering the prospects of such lamps being installed to illuminate roadways of new construction, roadways which heretofore have been illuminated and roadways which are presently illuminated by luminaires having high pressure sodium (HPS) sources. In the later case, notwithstanding initial purchase and installation costs, the economics are such that in a great number of instances there will be an economical advantage to replace luminaires with HPS sources for luminaires with LPS sources. This will be particularly true as energy and particularly electrical energy becomes more scarce and its cost increases. Studies have been made with LPS sources which have not had the benefit of the principles of the present invention which have influenced public works officials to make changes toward LPS systems in order to realize financial advantages. Thousands of dollars can be saved yearly even in communities or applications of relatively small size. It is not unreasonable to expect that tens to hundreds of thousands of dollars of savings can be realized by large municipalities.

BRIEF DESCRIPTION OF THE DRAWINGS

Objects and advantages of the invention will become apparent upon reading the following description and upon reference to the drawings, in which, like reference numerals refer to like elements in their various views:

FIG. 5 is a partial sectional lateral view of an exemplary low pressure sodium lamp.

FIG. 6 is a cross-sectional view of the low pressure sodium lamp as viewed in the direction of section 6—6 of FIG. 5.

FIG. 7 is a filter transmittance graph.

FIG. 8 is a graphical illustration of a transmittance function according to the principles of the present invention.

FIG. 9 is a graphical illustration of analytical design considerations for a reflector according to the principles of the present invention.

FIG. 10 is a partial sectional perspective view of a luminaire according to the principles of the present invention.

FIG. 11 is a partial sectional view of an exemplary device for supporting the cylindrical mirror and LPS source.

FIG. 12 is an elevational view, partly in perspective, of an embodiment of the present invention.

FIG. 13 is an enlarged sectional elevational view of the luminaire of FIG. 12 embodying the present invention.

FIG. 14 is a plan view illustrating light distribution of one embodiment of the present invention.

FIG. 15 is a schematic representation of a control range of light rays useable in the embodiment illustrated in FIG. 14.

DETAILED DESCRIPTION OF THE PREFERRED EMBODIMENTS

Figures 1A, 1B, 1C, 1D, 2A, 2B, 2C, 2D, 3A, 3B, 3C, 3D, 4A, 4B, 4C, 4D:
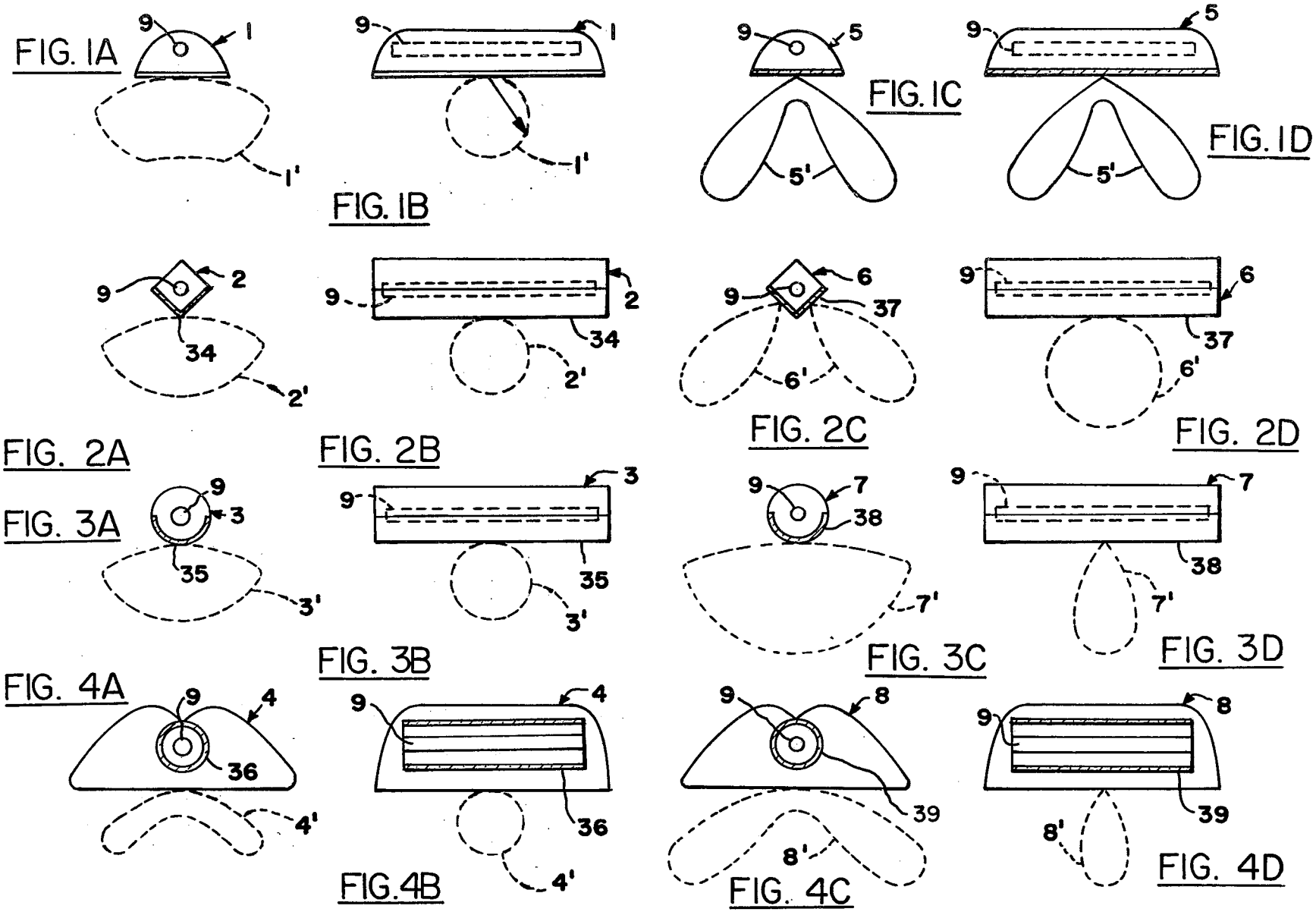
FIGS. 1A and 1B show diagrammatic illustrations of conventional luminaires in axial and lateral disposition showing polar plots of angular candlepower distribution.
FIGS. 1C and 1D show diagrammatic illustrations of prior art luminaires in axial and lateral disposition showing polar plots of angular candlepower distribution.
FIGS. 2A and 2B show diagrammatic illustrations of luminaires configured to the principles of this invention in axial and lateral disposition showing polar plots of angular candlepower distribution not controlled by multilayer interference film.
FIGS. 2C and 2D show diagrammatic illustrations of luminaires to the principles of this invention in axial and lateral disposition showing polar plots of angular candlepower distribution controlled by multilayer interference film.
FIGS. 3A and 3B show diagrammatic illustrations of luminaires configured to the principles of this invention in axial and lateral disposition showing polar plots of angular candlepower distribution not controlled by multilayer interference film.
FIGS. 3C and 3D show diagrammatic illustrations of luminaires to the principles of this invention in axial and lateral disposition showing polar plots of angular candlepower distribution controlled by multilayer interference film.
FIGS. 4A and 4B show diagrammatic illustrations of luminaires configured to the principles of this invention in axial and lateral disposition showing polar plots of angular candlepower distribution not controlled by multilayer interference film.
FIGS. 4C and 4D show diagrammatic illustrations of luminaires to the principles of this invention in axial and lateral disposition showing polar plots of angular candlepower distribution controlled by multilayer interference film.

The series of four FIGS. 1A–1D, 2A–2D, 3A–3D and 4A–4D illustrate the diagrammatic section of luminaires 1 thru 8 and their respective polar plots 1' thru 8' of angular candlepower distribution. In each of the four series of figures the first two figures, for example, FIG. 1A and FIG. 1B illustrate a luminaire having the light distribution plot for a conventional luminaire which is not according to the principles of the present invention. Likewise in FIGURE series 2, 3 and 4 the first two figures although not conventional are of unique configuration and are according to the principles of this invention but are shown to illustrate light patterns which are not influenced by multilayer interference films. Each of the four series of figures, for example, FIGS. 1A and 1C illustrates a light pattern when the luminaire is viewed in the direction of the axis of the illumination source 9. Whereas, FIGS. 1B and 1D illustrate the exemplary light pattern when viewed transverse to the axis of the illumination source.

In particular, FIGS. 1C–1D illustrate an embodiment according to the principles of the invention of the beforementioned U.S. patent application Ser. No. 716,409. The series of FIGS. 2, 3 and 4 illustrate exemplary light patterns possible under the principles of the present invention with the preferred embodiment being as illustrated in FIGS. 4C–4D. FIGS. 4C and 4D illustrate controlled patterns 8' which are preselected. The light pattern of FIG. 4C for specific application for roadway illumination would be controllably splayed upon the highway for extension of the wings of the light pattern in the direction of the highway. The light pattern of FIG. 4D is a directional pattern controllably splayed down upon the highway to prevent spewing of light off the near and far berm of the roadway. The light patterns of FIGS. 14, 15, 16 and 17 in contrast to those of FIGS. 4C and 4D are due in part to the different configuration of the reflector 140.

Figure 16:
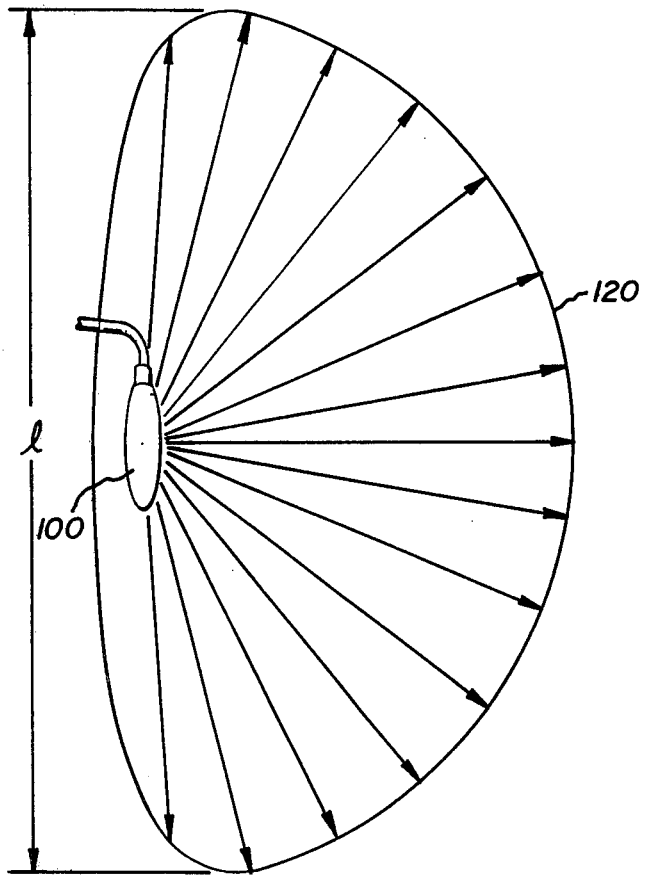
FIG. 16 is a plan view of a second embodiment of the present invention providing a controlled light distribution similar to that of FIG. 14 but disposed differently to the task area.

It should be appreciated from FIGS. 12 and 16 that these luminaires can be oriented at any selected direction to the roadway such as transversely or axially, to the roadway including an angle therebetween. Orientation applications of this sort are described in the publication Lighting Design & Application (LD&A), September 1975, at page 46 in an article entitled =Low-Pressure Sodium Lamps Light the 'Carriageways' of Johannesburg".

It is particularly useful when dealing with luminaires and the light sources used therewith to define terms which are used as a measure of the performance of luminaires with light sources.

The term luminous efficacy of a source of light is defined as the quotient of the total luminous flux emitted by the total lamp power input. It is expressed in lumens per watt. LPS sources possess very high luminous efficacy as compared with other light sources. The best commercially available LPS sources deliver 183 lm/watt. The best commercially available HPS sources deliver 125 lm/watt. The values are from LD&A September '75, page 39 and LD&A December '74, page 21.

The term luminaire efficiency is defined as the ratio of luminous flux (lumens) emitted by a luminaire to that emitted by the lamp or lamps therein. Commercially available LPS and HPS roadway luminaires possess comparable luminaire efficiencies. Values of 60–80% are typical.

The term coefficient of utilization (CU) is defined as the ratio of the luminous flux (lumens) from a luminaire received on the work-plane to the lumens emitted by the luminaire's lamps alone, as hereinbefore stated. The currently available and in use LPS roadway luminaires are characterized by relatively low utilization coefficients, as compared with HPS luminaires. This is especially true with lighting situations requiring the illumination of a relatively long or narrow stretch of roadway. Utilization coefficients can be expressed in terms of percentages, and 15–38% are typical for currently available LPS roadway luminaires. These low numbers result from the inability of current fixtures to control adequately the distribution of light from the luminaire. Thus, although the high efficacy of the LPS source itself makes it potentially the most economical for roadway illumination, the low utilization coefficients of the luminaires it is used in, prevent this from being realized. The present invention potentially can boost LPS roadway luminaire utilization coefficients by a factor of 2 or more. In this way, the potential of this highly efficant source is realized. Good roadway illumination can be provided at minimum power consumption. This is a significant motivation for the present invention. The deepening energy crisis will make this invention increasingly significant as time goes on.

The preferred monochromatic light source is a low pressure sodium lamp 10, as shown in FIG. 5, whose arc is carried through vaporized sodium 12. The starting gas 14 usually neon with small additions of helium, argon or xenon. Ideally, for maximum efficacy, the vapor pressure of the sodium is in the order of $\times 10^{-3}$ millimeters of mercury corresponding to an arc tube bulb wall temperature of approximately 500° F. This pressure provides for the maximum efficacy of the conversion of the electrical input to the arc discharge into light. Significant departure from this pressure results in appreciable and undesirable loss in the lamp efficacy. To regulate or control a proper operating temperature, the sodium arc tube is enclosed in a vacuum enclosure 16 at high vacuum 18. The light produced by the low pressure sodium arc is nearly monochromatic, having a double line in the yellow region of the spectrum at 589 and 589.6 nanometers.

After energization of the lamp the time to full light output is 7 to 15 minutes. Initially, the light output is a characteristic red of the neon discharge. Gradually, the characteristic yellow, as the sodium is vaporized, becomes prominent.

Different types of arc tube construction are used in present day low pressure sodium lamps. One embodiment is the hairpin, or "U" tube 20, as shown in FIG. 5 and another the linear type. In the hairpin construction, the arc tube is doubled back on itself with its respective legs 22 and 24 being very close together. The electrodes 26 and 28 in their base are sealed in at the ends of each respective leg of the arc tube, the whole of which is mounted inside an outer vacuum enclosure 16. A two pin bayonet base 30 provides external contacts for the electrodes.

In a linear lamp, the arc tube is double ended with an electrode at each end. The tube is dimpled at regular intervals. The inner tube is sealed into an outer vacuum enclosure. In both the hairpin and linear tubes, the electrodes are maintained at an electron-emissive temperature by ion bombardment after the initial arc is struck.

Low current density is essential for efficient generation of resonance radiation. High densities result in higher excitation phenomena and loss of resonance radiation. Considerable good work has been accomplished in the field of thermal insulation recently, resulting in available efficacies in excess of 170 lumens per watt for the 180-watt "U" type low pressure sodium lamp. The thermal insulation can consist of a light transparent infrared reflecting layer on the inside of the outer enclosure or envelope. Presently, this is an indium oxide layer, which replaces a tin oxide layer.

The 180 watt LPS source is rated at 18,000 hours with lumen maintenance close to 100% at end of lamp life as disclosed in LD&A September '75, page 71. In comparison, the 400 watt HPS source is rated at 20,000 hours. Luminous output decreases with age. Lumen maintenance is in the neighborhood of 90% at end of lamp life as disclosed in LD&A December '74, page 21.

Other monochromatic light sources include, as beforementioned, neon lamps and lasers. Another alternate source of light, for example, is a light emitting diode (LED) which has a useful bandwidth of approximately 50 nanometers or less. For the sake of applications for the inventions of this disclosure monochromatic light radiation will be considered to be radiation falling within ± 25 nanometers of a single wavelength. This is generally satisfactory notwithstanding that monochromatic strictly speaking refers to a light of only one wavelength. In practical applications such is never the case and tolerances are necessary.

For purposes of this invention, multilayered optical film 32 or its equivalent multilayered interference film 32 refers to a material consisting of a series of thin layers of accurately controlled thickness. Adjacent layers have different indices of refraction. Layer thicknesses and indices of refraction are chosen to cause interference of light waves passing through the material. The interference of the light waves results in the desired control of the light.

The beforementioned U.S. patent application Ser. No. 716,409 discuss use of an angularly sensitive plate to force directionality from the large monochromatic sodium source. Consider now a plate which transmits predominantly at small angles of incidence, the angle from the normal. The graph of the transmittance as a function of the angle of incidence will look like a forward-directed balloon as seen in FIG. 8. In this relationship the solid angle subtended by the directional balloon is a small fraction of the hemisphere representative of a large diffuse light source. This means that only a small fraction of the light is transmitted on first encounter with the surface, the rest being reflected back into the system. If the plate is a reasonable distance from the source i.e. large compared with the width of the source, the light can be described as entering not from the entire hemisphere but from a longitudinal section of the hemisphere oriented parallel to the line source. This section can be visualized as a section of an orange. It therefore is an advantage to direct the acceptance balloon into the section in order to assure maximum transmittance. The transmittance is now given by the balloon to section ratio rather than the balloon to hemisphere ratio. Directing the balloon toward the center of the section corresponds to using a cylindrical directionally sensitive plate centered about the source. The transmittance, T, of the plate relative to the source is now essentially given by:

$$T = \frac{\int_0^{\pi/2} B(\theta)\cos\theta\, d\theta}{\int_0^{\pi/2} \cos\theta\, d\theta} = \int_0^{\pi/2} B(\theta)\cos\theta\, d\theta\,,$$

where

T is first-pass transmittance for narrow line source;

$B(\theta)$ is the balloon directional transmittance function; and $\theta$ is the angle of incidence as seen in FIG. 8.

If the width of the line source is significant, it will be necessary to integrate in two dimensions. This will yield slightly lower values for T.

The above arrangement of a cylinder about the source accomplishes an effective foreshortening of the source as seen from outside of the cylinder. If the system suffers no absorption losses, efficiency is 100%. Of course, this is not the case and efficiency will be degraded by absorption.

The net transmittance of the cylinder, $T_{net}$, is greater than T because much of the light reflected back into the system is scattered and re-emitted. The following equation applies:

$$T_{net} = \frac{T}{1-(1-T-A_F)(1-A_s)}$$

where $A_F$ is the absorption coefficient of the film;

$A_s$ is the functional absorption coefficient of the source; and $T_{net}$ is the overall transmittance of the cylinder when used with line source.

The film coating to be applied to any of the substrates 34, 35 and 36 illustrated in FIGS. 2A–2B, 3A–3B and 4A–4B to produce mirrors 37, 38 and 39 of FIGS. 2C, 3C and 4C is, as will be appreciated by those of skill in the art, dependent upon the particular shape or configuration and material of the substrate. This factor is a consideration due to the change in the angle of incidence of the light emitting from the light source and traveling through the substrate and coating, in order to be directed into a light pattern of desirable and preselected shape.

The book entitled *Thin-Film Optical Filters* by H. A. Macleod, published by Adam Hilger Limited, London and copyrighted 1969 provides basic teaching to the design of multilayer interference films which are otherwise generally referred to as, for example, edge filters, band pass filters, spike transmission filters or generally interference filters. Although not particularly ideal for the preferred embodiment of the present invention a suitable film might be an all-dielectric Fabry-Perot filter as described in-part beginning at page 165 of the beforementioned book entitled *Thin-Film Optical Filters.*

In the preferred embodiment of the configured cylindrical tube 36 to pass over the light source, the coating selected is designed under the principle that as the angle of incidence of the light increases the cut off wavelength of the filter decreases. Other coating configurations where different control effects are desired in the direction of the roadway are possible such as, for example, when an edge filter film layer is used, which has the percent of transmission sharply dropping off at some given wavelength in the direction of increasing wavelength; the coating thickness around the outside of the cylinder is made to vary such that the material is thickest at that part of the tube 39 which faces the task surface or, for example, the roadway and is thinnest on the upper part of the cylinder 39 facing the inside of the luminaire fixture.

Of course, it is well appreciated that the reverse principle can be utilized where a film whose percent of transmission increases sharply at some given wavelength in the direction of increasing wavelengths and the film will be thickest at the upper part of the cylinder 39 which faces the reflector.

In the Macleod text entitled *Thin-Film Optical Filters* numerous film materials are suggested for achieving the desired results. Those are just some of the film materials which are useful. It will be appreciated that particular film materials may need to be considered in order to adequately compensate for substrates which have a higher level of heat such as the outer envelope 16 of the low pressure sodium lamp 10 as illustrated in FIG. 5. Other material considerations might be necessary because of the material of the substrate in order to provide for a satisfactory bond of the film to the substrate.

Much better net efficiencies are realized through these applications but the problem is not as yet complete. The lamp with a diffuse reflector is essentially a completed luminaire having a batwing light pattern output. The preferred cylinder and source must fit within a reflector or other appropriate configured luminaire to yield the up-and-down-the-road directionality required.

As illustrated in the series of FIGS. 2, 3 and 4, the configuration of the plate or mirror surfaces can vary according to the principles of the present invention. Whether the multilayer interference mirror is comprised of a plurality of flat surfaces such as illustrated in FIGS. 2C–2D or is semi-cylindrical as illustrated in FIGS. 3C–3D or is substantially cylindrical in shape as illustrated in FIGS. 4C–4D, the benefits of this contribution to the state of the art can be realized. It will be appreciated that the design of the multi-film layer to be disposed upon the specially configured mirror substrate is very dependent upon the configuration of the substrate. Although not shown, configurations which are not symmetrical about the axis of the illumination source are also possible and could comprise, for example, smooth curved surfaces which may approximate, for example, elliptical or paraboloidal shapes. Further, the cylinder 39, as illustrated in the series of FIGS. 4C–4D could be defined as slightly elliptical with the focii of the eclipse being centered at the optical axis of each respective leg 22 and 24 of a LPS "U" tube source 10. As illustrated in FIGS. 4C and 9 it is generally preferred that the axis of the cylindrical interference film mirror is concentric with the axis of the outer envelope 16 of the LPS source 10, as further illustrated in FIG. 13.

The series of FIGS. 12–17 illustrate embodiments which incorporate the principles of this invention. As best seen in FIG. 12, an elongated luminaire 100 is used to illuminate a relatively even task 120, which is preferably a roadway. Luminaire 100, as best seen in FIG. 13, has a reflector 140, an elongated tubular light source 160 and an elongated tubular multilayer light interference mirror 180. Reflector 140 is operably disposed to reflect a portion of light emitted from the light source 160 onto the task area 120. Reflector 140 and mirror 180 are constructed to cooperate in providing the desired distribution of light from luminaire 100 onto area 120 which differs, for example, from that illustrated in FIGS. 4C and 4D.

The elongated tubular light source 160 is selected to emit monochromatic light. The most preferred embodiment uses low pressure sodium lamps, such as that designated in the IES Lighting Handbook as SOX 180W.

Multilayer interference light mirror 180 is a multiple layered film stack that selectively reflects and transmits light as a function of wavelength and angle of incidence by the phenomena of optical interference. As discussed, such mirrors are known in the optical thin film art and their design is determined by the desired amount of reflectance and transmittance of light. As disclosed herein, the reflection and transmission is dependent on the wavelength of light passing through the multilayer, the thickness and index of refraction of the materials used in each layer of the multilayer stack and the angle of incidence of the incoming light rays.

Multilayer interference mirror 180 is constructed to angularly select a portion of the light arriving from a multiplicity of directions for passage into a desired control range. Since light source 160 provides monochromatic light and, for design purposes, the angle of incidence of the incoming light rays is equal to the angle of incidence of the outgoing light rays, then the thickness and index of refraction of the materials in each layer of the multilayer stack are the only determinations which must be made. These determinations are provided for within this disclosure. Once the thickness of the materials used in each layer is selected, mirror 180 is disposed on an elongated tubular substrate. The light permitted to pass will be distributed within a control range. Preferably, the control range is substantially between angles $\theta_1$ and $\theta_2$ from and symmetrically disposed about a perpendicular drawn to a finite portion 220 of mirror 180. The finite portion 220 of FIG. 15 is located in a plane positioned transversely to the elongated axis of mirror 180, which mirror 180 is as illustrated in FIG. 13.

When desired, an elongated tubular diffuser 200 may be disposed about the elongated tubular light source. Such diffuser will cause the light being emitted from light source 160 to be diffused over the surface of multilayer interference light mirror 180. Diffuser 200 may be of separate elongated tubular construction, such as a piece of glass having an etched surface, or the glass envelope of light source 160 may be etched.

In the preferred embodiment, task area 120 is a roadway. The IES recommends that luminaire 100 be designed to distribute light in ratios of the width of the roadway (w) to be illuminated to the mounting height (h) of luminaire 100 and of the length of the roadway (1) to be illuminated to h. Further, the IES specifies "lateral" light distribution (light distributed transversely to the roadway) and "vertical" light distribution (light distributed along the roadway) as the design criteria for a luminaire to provide adequate roadway illumination. Two methods that may be used for providing this distribution of light are by disposing the elongated axis of luminaire 100 transversely to the roadway and by disposing the elongated axis of luminaire 100 along the roadway.

When luminaire 100 has the elongated axis disposed transversely to the roadway, as illustrated in FIG. 14, mirror 180 is selected to control light emissions transversely to the roadway along the elongated axis of light source 160, while reflector 140 is constructed to control the distribution of light along the roadway, as transversely to the elongated axis of light source 160. As shown in FIG. 15, the light distribution is controlled substantially between 0° and 50° from and symmetrically disposed about a perpendicular drawn to finite portion 220 for this type of embodiment. Reflector 140 will then be of conventional shape to provide the selected control over the distribution of light along the roadway.

Figure 17:
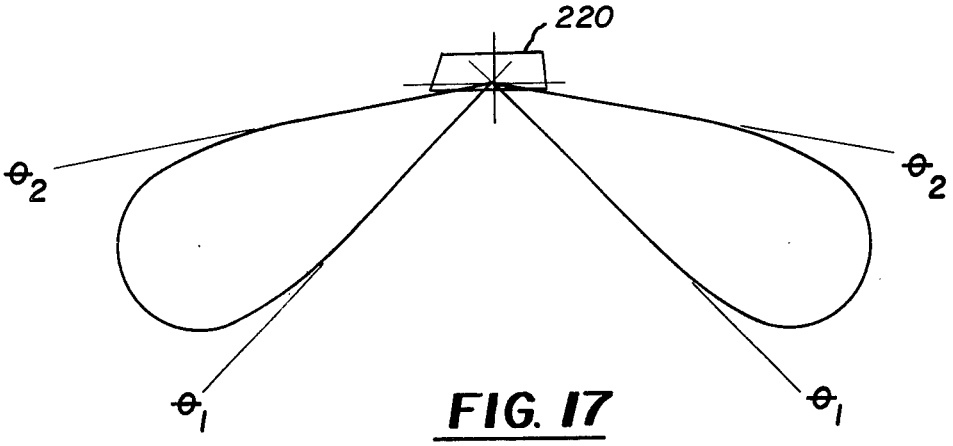
FIG. 17 is a schematic representation of a control range of light rays useable in the embodiment illustrated in FIG. 16.

When the luminaire 100 has the elongated axis disposed along the roadway, as illustrated in FIG. 16, mirror 180 is selected to control light emissions along the roadway, along the elongated axis of light source 160, while reflector 140 is constructed to control the light distribution transversely to the roadway, transversely to the elongated axis of light source 160. As shown in FIG. 17, the light distribution is controlled substantially between 45° and 80° from and symmetrically disposed about a perpendicular drawn to finite portion 220.

This invention generally relates to the use of directionally sensitive coatings for light pattern control. In the roadway luminaire, the reflector design must be compatible with the concept. The coating can either control the light distribution pattern laterally or transversely to the source, as hereinbefore mentioned while the reflector and/or refractor controls transversely or laterally to the source axis, respectively. This can depend on whether the luminaire is disposed with the source transverse to the roadway or lateral to the roadway, respectively. Although a wide variety of specific reflector-refractor designs may prove useful, the above principles dictate certain preferred configurations. A test entitled "The Optical Design of Reflectors" by author William B. Elmer, copyrighted 1974 and identified by Library of Congress Catalog Card Number 75-15121 is particularly useful in designs in such reflectors.

There are many preferred luminaire characteristics all of which are not possible or desirable for incorporation in a single luminaire. These are as follows: (a) the reflector should be specular, especially when the coating is on a cylindrical substrate and the illumination pattern is to cover a relatively long stretch of roadway or a relatively narrow roadway; (b) the embodiment using one or more flat coated plates may perform best when used with diffuse reflectors; (c) the reflector should have curvature only in the transverse direction (the direction in which it affects control) and it should not be curved in the lateral directional so that it does not interfere with the lateral control achieved with the coating, with the understanding that mild lateral curvature is acceptable; (d) rounded reflector ends are also permissible to give the reflector a more desirable mechanical shape and such adjustments should not alter the lighting pattern appreciably; (e) the reflector may be "hybrid" as defined in the beforementioned Elmer text at page 20, for hybridization can help achieve the desired beam characteristics specified by the IES and yet prevent unwanted ray-interactions within the luminaire such as a ray striking the reflector more than once; (f) the "lens" can be a simple window to protect the source and interior reflector surface from the elements, or it may have Fresnel grooves on one or both sides to modify the beam into a more desirable pattern with the reflector serving the primary function of transverse control which the refractor may augment; (g) the reflector may consist of various "convergent" and/or "divergent" zones as defined in the Elmer text at page 16, as illustrated in FIG. 10; (h) the reflector may be relatively compact and yet achieve control of the light because the coating achieves control laterally and the refractor-reflector design can concentrate an optimum transverse control; (i) Fresnel grooves, if used, are oriented laterally to the source; (j) it is preferred that the reflector be generally above the source and the "lens" generally below, and options utilizing "compound" reflectors may be desirable for some pattern types as defined in the Elmer text at page 16; (k) reflector-refractor, design will depend upon the lighting pattern desired, but may correspond to conventional configurations already used; and (l) the design of the optical multilayered coating will also depend upon the lighting pattern desired.

These design techniques have to some extent been elevated from the realm of theory as explored by W. A. Elmer, in the beforementioned book on reflector design. Below are discussions based upon the book disclosure pertinent to roadway reflector design. The roadway luminaire falls under the "remote task" heading of Elmer's text disclosure. This means that the overall size of the luminaire is small compared with its distance from the area to be illuminated. In such cases, the desired lighting pattern is specified in angular rather than linear (length) units. This is the same way in which the IES specifies roadway luminaires. From the Elmer disclosure, relative to curve generation for remote task reflectors, it is pointed out that when the reflector dimensions are negligible in relation to the distance to the lighting task, as in most outdoor lighting, it is possible to prepare a tabulation of the expected reflector performance in the form of specific pairs of incident (alpha) and reflected (beta) ray angles. This is best seen in FIG. 9 which illustrates the slope of the tangent to a curve of the reflector in terms of the alpha and beta angles. No matter how arrived at, with this tabulation a reflector curve can be determined either by ray tracing or by calculation. If the alpha-beta ray characteristic is available in the form of an explicit mathematical expression, the curve can be calculated directly and the tabulation of ray pairs and ray tracing can be dispensed with competely, if desired.

If the mathematical expression is not integrable, the tabulation of $\alpha$ vs B values can be gotten by conventional methods of substituting values of one variable and solving for the other, until enough pairs are available to generate the curve.

This is also true for non-regular distributions or those not expressable mathematically, including even empirically drawn beam shapes. This is provided that the task is remote.

For a roadway reflector, which possesses curvature primarily only in the plane transverse to the axis of the source, the following first order differential equation can be used to generate the required table of $\alpha$, $\beta$ angular pairs:

$$\frac{d\alpha}{d\beta} = \frac{CP_o(\beta) - CP_d(\beta)}{R(eff)\ CP_s(\alpha)},$$

where $d\alpha$ is the alpha differential;

$d\beta$ is the beta differential;

$CP_o(\beta)$ is the desired candlepower leaving the luminaire at angle B;

$CP_d(\beta)$ is the direct candlepower leaving the source at angle $\beta$ and exiting the luminaire, (Note that $CP_d(\beta)=CP_s(\pi-\beta)$);

R(eff) is the reflectivity of the specular reflector; and $CP_s(\alpha)$ is the directional candlepower characteristic of the source at angle $\alpha$.

The shape of the reflector surface itself is generated by either an analytic solution of Equation 37 on page 105 of the Elmer text, or using a graphical technique described within the Elmer text. The analytic equation can be written in polar form as:

$$dr/r = \tan(\alpha-\beta)/2\ d\alpha.$$

This is recognized as another first order differential equation:

$$dr/d\alpha = r \tan(\alpha-\beta)/2,$$

where $(r,\alpha)$ are the polar coordinates of points on the reflector. The graphical method of achieving the reflector shape is also disclosed in the Elmer text. Differential equations identified from the Elmer text describe a series or family of possible solutions. In order to specify one particular solution, it is necessary to set "boundary conditions". Such terms as "congruent" correspond to these boundary conditions. "Convergent" and "divergent" are other pertinent terms. The design effects of boundary considerations are exaggerated in FIG. 10 as illustrated by convergent reflector kinks 40 in the continuity of the curve of the reflector 42.

In generating solutions, it is also necessary to satisfy "conservation equations". These equations assure that the total light leaving the luminaire is equal to the total light leaving the source, modified by appropriate reflectivity factors. According to the Elmer text disclosure at page 124, this involves an elementary integral equation of the type:

$$\textit{Reflectance} \int \textit{Incident Flux} = \int \textit{Reflected Flux}.$$

In a hybrid design, the above design techniques are still used, although the input angles $\alpha$ and output angles B are subdivided into associated sub-intervals. This allows further flexibility in design. The Elmer text describes the concept of such reflectors.

It will be appreciated that other design considerations can be incorporated into luminaire fixtures such as those illustrated in FIGS. 1A–4D and, for example, the refractor, as illustrated in those figures, may be modified to deviate light to the sides to control the down light.

To make a basic projection of the improvement this invention will make over current LPS luminaires a comparison study of the coefficients of utilization is made. For this purpose the "typical roadway" shown on page 9–72 of the IES Lighting Handbook is selected.

It is assumed, reasonably, that the current luminaires output a cosine pattern in the plane of the drawing. This assumption is reasonable because the reflector-refractor can essentially do nothing to alter the natural cosine distributor from the long line source. It is noted that the luminaire cannot satisfy the IES type specifications since the ½ maximum CP overshoots the roadway edges, where CP is defined as candlepower. Nonetheless, the CU is optimized by positioning the CP maximum point on the roadway center (angular). It is noted further that the roadway subtends an angle of 65.77° as seen from the lamp. Assuming symmetry about the axis of the road the utilization is then given by:

$$CU = \text{Efficiency} \times \frac{\int_0^{\theta_c} \cos\theta \, d\theta}{\int_0^{\pi/2} \cos\theta \, d\theta},$$

where $\theta_c$ defines the edges of the roadway.

Therefore, the CU of currently available luminaries=0.543×efficiency. With a luminaire efficiency of 70% this gives a CU, as expressed in percentage, of 38%.

The distribution that can be expected from a single pass through a dielectric filter, for example, a Bausch & Lomb 90-1-620 filter as defined in FIG. 7 is the next part of the comparison study. The method involves locating the best wavelength, for best angular dependence. It will then be necessary plot $t(\theta)$ at that wavelength. Reasonable assumptions are then made to predict the lamp output pattern $CP(\theta)$. From this, computation of the CU can be made and compared with that of currently available LPS luminaires. In particular, for cylindrical coating centered about a line source, the pattern is one-dimensional and the same as the filter transmittance function in shape. This makes the computation somewhat less difficult.

The CP as a function of $\theta$ for line source lateral distribution for the filtered case is given by:

$$CP(\theta) = t(\theta) \cos(\theta)$$

Since the spread is strictly in the plane of the paper, the pertinent ratio is given by:

$$\frac{\int_0^{\theta_c} CP(\theta)\, d\theta}{\int_0^{\pi/2} CP(\theta)\, d\theta}$$

Efficiency effects CU in the following relationship:

$$CU = \text{efficiency} \times \frac{\int_0^{\theta_c} CP(\theta)\, d\theta}{\int_0^{\pi/2} CP(\theta)\, d\theta}$$

The above relationship is based upon a luminaire with spill-over occurring only in a cross the road direction and with $CP(\theta)$ in that direction independent of down the road distribution. It is noted that this is never actually true and that more sophisticated computation is necessary. Nonetheless, it suffices for this comparison of a very short pattern. This simplified equation when solved gives CU of 61%–65% for the filtered luminaire according to the principles of this invention.

These figures are somewhat unrealistic and better comparison can be made when short, medium and long configurations are analyzed. This can be taken into account by noting that the road width appears foreshortened by a factor of roughly $1/\cos\rho$ where $\rho$ is the "along the road angle". This is believed to be comparable to the IES use of "sinusoidal web". Rather than performing two tedious two dimensional integrations, assumptions are made that one can average at the point $1/\sqrt{2}$ out to the CP max position (lateral along roadway).

Based on reasonable assumptions and assuming some net efficiencies for the luminaries, the following figures for comparing current luminaries with filtered luminaries using the B&L 90-1-620 type coating have been calculated.

| | CU-Not Filtered | CU-Filtered |
|---|---|---|
| Short | 35.4–17.8% | 65.0–40.8% |
| Medium | 17.8–10.9% | 40.8–25.6% |
| Long | 10.9–6.8% | 25.6–16.2% |

The average improvement as roughly calculated is a factor of 2.2.

Mounting hardware for LPS roadway luminaire components such as the cylindrical mirror is necessary to maintain the preferred disposition as shown in FIG. 10 between the cylinder and the LPS source, and to support the cylinder.

In FIG. 11 an exemplary spacer and support device 44 is illustrated. This spacer 44 aids in supporting the cylindrical interference mirror at the end opposite the receptacle of the LPS source in the luminaire fixture. In addition, it supports the envelope 16 of the LPS source at that same end and provides for concentricity between the LPS source and the cylindrical mirror. The spacer, for example, may have an overcenter hinge 46 so that the position, as illustrated in FIG. 10, is maintained unless some kind of extra force is applied to pivot the support spacer 44 away from the LPS source 10 such as might be necessary when servicing the luminaire. At the electrode end of the cylinder some suitable clip or base formation will be provided to position and support the cylinder.

It will be appreciated that other apparatus can be devised to either individually support the LPS source and cylindrical mirror or to cooperatively support both. The following are just some other of the options which could be incorporated for such support purposes. If a diffusing coating is used, it can be laminated or painted onto the source cylinder itself or incorporated into a separate cylindrical tube surrounding the source tube. The interference coating may be deposited directly onto or inside the source tube, or onto a separate surrounding tube. In any event, the diffuse coating lies inside of the interference coating, when the diffuse coating is used. The interference coating may be deposited onto a suitable flexible substrate, such as thin sheet plastic, and laminated onto a structurally supporting tube, which may be the outer jacket of the source tube itself. The coated tube may be positioned and supported relative to the other optical components, using spring type wire or metal band clips which connect it to the reflector or lamp housing. If the coated tube is reasonably light in weight, it may be connected to the source tube for support, using spider-type wire supports which hold it properly relative to the source tube, and support it mechanically. Alternately, the light weight coated tube described above, may be supported externally by plastic or metal spider mounts connecting it to the reflector, refractor, housing assembly. A coated polyimide laminated directly to the source tube may be particularly useful because the material holds up under high heat. Such material may alternately be mechanically clipped onto the source tube.

Two semi-cylinders, one mounted onto the reflector or housing and the other to the refracting window, are a possible alternative. In this way, when the luminaire is opened for maintenance, the cylinder is separated, allowing easy access to the light source. The cylinder could be supported by the reflector or lens by means of a structural boss support or on a ridge. The end of the luminaire fixture opposite the lamp socket could be removable for changing source. The cylinder could be in the form of a close-fitting sleeve over the source. In all of the beforementioned alternatives, the coating can be on the inside, outside or both sides of the substrate.

From the foregoing, it will be seen that novel and advantageous provision has been made for carrying out the desired end. However, attention is again directed to the fact that variations may be made in the example method and apparatus disclosed herein without departing from the spirit and scope of the invention, as defined in the appended claims.

It is claimed:

1. A luminaire fixture of high illumination efficiency structured to house a monochromatic light source and capable to control the direction of light emittable from such light source to illuminate a task area in a controlled intensified light pattern, comprising:

receptacle means for defining a designated lamp space and capable to receive a monochromatic light source to occupy the designated lamp space;

reflector means including a reflective surface disposed about the designated lamp space for reflecting light from the reflective surface toward the task area; and multilayer interference mirror means geometrically configured to define an interference film surface the cross section and profile of which is nonlinear between points defining the extremities of the interference film surface, the interference film surface being disposed about the designated lamp space and supporting a multilayer interference film for receiving light emittable from a monochromatic light source to occupy the designated lamp space, and light to be reflected by the reflector means receivable directly from a monochromatic light source to occupy the designated lamp space and light reflected from the multilayer interference film, for passage through the geometrically configured multilayer interference mirror means, of that light received at predetermined angles of incidence into controlled angular directions and to reflect the light received at other than the predetermined angles of incidence to thereby illuminate the task area in a controlled intensified light pattern.

2. The luminaire fixture as defined in claim 1, wherein the reflector means is concave toward the task area.

3. The luminaire fixture as defined in claim 2, wherein the reflector means is defined by a plurality of convergent reflective surface.

4. The luminaire fixture as defined in claim 2, wherein the reflector means is defined by a plurality of convergent and divergent reflective surfaces.

5. The luminaire fixture as defined in claim 1, wherein the multilayer interference mirror means has a cross section and profile which is arcuate.

6. The luminaire fixture as defined in claim 5, wherein the arcuate cross section and profile of the mirror means is of uniform curvature.

7. The luminaire fixture as defined in claim 6, wherein the cross section and profile of uniform curvature of the mirror means defines an arc of at least half a circle.

8. The luminaire fixture as defined in claim 5, where the arcuate cross section and profile of the multilayer interference mirror means is defined by three sections, at least two of which are arcuate in cross section, which three sections meet to partially encompass the designated lamp space and define an interference film surface which is of non-uniform curvature.

9. The luminaire fixture as defined in claim 1, wherein the multilayer interference mirror means has a cross section and profile which is comprised of a plurality of linear sections.

10. The luminaire fixture as defined in claim 9, wherein the cross section and profile of the multilayer interference mirror means is defined by a plurality of three linear sections.

11. The luminaire fixture as defined in claim 1, wherein the multilayer interference mirror means is cylindrical in shape.

12. A luminaire assembly of high illumination efficiency for controlling the direction of light to illuminate a task surface in a controlled intensified light pattern, comprising:

illumination means for transmitting monochromatic light;

reflecting means having a reflecting surface disposed about the illumination means to form a luminaire aperture through which passes light emanating directly from the illumination means and light reflected from the reflecting surface of the reflecting means to illuminate the task surface; and multilayer interference mirror means geometrically configured to define an interference film surface the cross sectional profile of which is nonlinear between points defining the extremities of the interference film surface, the interference film surface supporting a multilayer interference film for receiving the light passing through the luminaire aperture which light is transmitted directly from said illumination means and is reflected from said reflecting means, for passing through the multilayer interference film light received at predetermined angles of incidence and for reflecting other light transmitted from the illumination means and reflected from the reflecting means which other light is thereafter again received by the multilayer interference film after being reflected by the reflecting means for passage through the multilayer interference film when received at the predetermined angles of incidence to intensify the light illuminating the task surface by controlling the angular direction of light passing through the multilayer interference film to illuminate the task surface in a controlled intensified light pattern.

13. The luminaire assembly as defined in claim 12, wherein the illumination means symmetrically transmits monochromatic light about an illumination axis.

14. The luminaire assembly as defined in claim 13, wherein the reflecting means is concave when viewed along the illumination axis.

15. The luminaire assembly as defined in claim 14, wherein the reflecting means has a plurality of divergent and convergent reflective surfaces.

16. The luminaire assembly as defined in claim 12, wherein the illumination means is a low pressure sodium light source.

17. The luminaire assembly as defined in claim 16, wherein the reflecting means is defined by a plurality of convergent reflecting surfaces.

18. The luminaire assembly as defined in claim 12, wherein the multilayer interference mirror means has a cross sectional profile which is arcuate.

19. The luminaire assembly as defined in claim 18, wherein the arucate arcuate sectional profile of the mirror means is of uniform curvature.

20. The luminaire assembly as defined in claim 19, wherein the cross-sectional profile of uniform curvature of the mirror means defines an arc of at least half of a circle.

21. The luminaire assembly as defined in claim 18, where the arcuate cross sectional profile of the multilayer interference mirror means is defined by three sections, at least two of which are arcuate in cross section, which three sections meet to partially encompass the illumination means and define an interference film surface which is of non-uniform curvature.

22. The luminaire assembly as defined in claim 12, wherein the multilayer interference mirror means has a cross sectional profile which is comprised of a plurality of linear sections.

23. The luminaire assembly as defined in claim 22, wherein the cross sectional profile of the multilayer interference mirror means is defined by a plurality of three linear sections.

24. The luminaire assembly as defined in claim 12, wherein the multilayer interference mirror means is disposed between the illumination means and the luminaire aperture.

25. The luminaire assembly as defined in claim 12, further including refractor means disposed at the luminaire aperture for receiving light from the interference mirror means to further control the resultant intensified light pattern.

26. The luminaire assembly of high illumination efficiency for controlling the direction of light to illuminate a task surface in a controlled intensified light pattern, comprising:

illumination means for emitting monochromatic light;

multilayer interference mirror means disposed around the illumination means and geometrically configured to define a cylindrical interference film surface, the cylindrical interference film surface supporting a multilayer interference film for receiving the light emitted directly from the illumination means for passing through the multilayer interference film light received at predetermined angles of incidence and for reflecting as a first function in a repeatable sequence of functions that light received at other than the predetermined angles of incidence back to the illumination means which scatters the reflected light as a second function in the sequence of functions, which scattered light is received at the multilayer interference film to be passed therethrough as a third function in the sequence of functions when received at the predetermined angles of incidence and the light at other than the predetermined angles of incidence to be reflected back to repeat the sequence of functions, the light received by the multilayer interference film at the predetermined angles of incidence being passed by the multilayer interference film at controlled angular directions to intensify the light and to direct the intensified light in a first directional range toward the task surface and in a second directional range; and reflecting means for receiving intensified light passed by the multilayer interference film in the second directional range to reflect the received intensified light toward the task surface in controlled angular directions to combine with the intensified light directed by the multilayer interference film in the first directional range toward the task surface, to illuminate the task surface in a controlled intensified light pattern.

27. The luminaire assembly as defined in claim 26, wherein the cylindrical surface of the multilayer interference mirror means is disposed concentrically about the illumination means.

28. The luminaire assembly as defined in claim 26, wherein the illumination means for emitting monochromatic light is elongated and tubular in shape and the cylindrical interference film surface of the multilayer interference mirror means is of elongated and tubular shape.

29. The luminaire of claim 28, including diffuser means for diffusing the monochromatic light emitted from said illumination means.

30. The luminaire of claim 29, wherein said diffuser means is elongated, tubular and disposed between said illumination means and said mirror means.

31. The luminaire of claim 28, wherein said illumination means is a low pressure sodium lamp.

32. The luminaire of claim 28, wherein the controlled angular direction is substantially between 45° and 80° from and symmetrically disposed about a perpendicular drawn to a finite portion of said mirror means, the finite portion of said mirror means being located in a plane disposed transversely to the axis of the cylindrical surface of said mirror means.

33. The luminaire of claim 28, wherein the controlled angular direction is substantially between 0° and 50° from and symmetrically disposed about a perpendicular drawn to a finite portion of said mirror means, the finite portion of said mirror means being located in a plane disposed transversely to the axis of the cylindrical surface of said mirror means.

34. The luminaire assembly as defined in claim 26, wherein the task surface is a roadway and the illumination means for emitting monochromatic light is an elongated tubular low pressure sodium lamp and the cylindrical interference film surface of the multilayer interference mirror means is elongated and tubular.

35. The luminaire assembly of claim 34, wherein the controlled angular direction is substantially about a perpendicular drawn to a finite portion of said mirror means, the finite portion of said mirror means being located in a plane disposed transversely to the axis of the cylindrical surface of said mirror means.

36. The luminaire assembly of claim 34, wherein the controlled angular direction is substantially between 0° and 50° to and symmetrically disposed about a perpendicular drawn to a finite portion of said mirror means, the finite portion of said mirror means being located in a plane disposed transversely to the axis of the cylindrical surface of said mirror means.

37. The luminaire assembly as defined in claim 34, further including diffuser means for diffusing the monochromatic light emitted from the low pressure sodium lamp and wherein the elongated and tubular shaped multilayer interference film surface is disposed substantially coaxially with said diffusing means.

38. A luminaire assembly of high illumination efficiency for controlling the direction of light to illuminate a substantially planar task surface in a controlled intensified light pattern, comprising:

illumination means for emitting monochromatic light symmetrically about an illumination axis disposed substantially parallel to the substantially planar task surface;

reflecting means having a reflective surface disposed about the illumination means to form a luminaire aperture through which passes light emitted directly from the illumination means and light reflected from the reflecting surface of the reflecting means; and multilayer interference mirror means disposed substantially parallel to the illumination axis and at least partially about the illumination means and geometrically configured to define an interference film surface having a sectional profile across the illumination axis which is other than parallel to the planar task surface, the interference film surface supporting a multilayer interference film for receiving the light passing through the luminaire aperture which light is emitted directly from said illumination means and is reflected from said reflecting means for passing, through the multilayer interference film, light received at predetermined angles of incidence and for reflecting other light emitted from the illumination means and reflected from the reflecting means which other light is thereafter again received by the multilayer interference film after being reflected by the reflecting means for passage through the multilayer interference film when received at the predetermined angles of incidence which light passing through the multilayer interference film forms an intensified light pattern which has a batwing configuration when viewed in the direction of the illumination axis and a down-light pattern when viewed in a direction at right angles to the illumination axis to intensify the light illumination the planar task surface by controlling the angular direction of light passing through the multilayer interference film to illuminate the task surface in a controlled intensified light pattern.

* * * * *

UNITED STATES PATENT AND TRADEMARK OFFICE

CERTIFICATE OF CORRECTION

PATENT NO. : 4,161,014

DATED : July 10, 1979

INVENTOR(S) : Thomas W. Dey et al

It is certified that error appears in the above-identified patent and that said Letters Patent are hereby corrected as shown below:

Col. 2, line 15, delete "aforementioned" and substitute therefor --beforementioned--;

line 22, before "diffuse" insert --a--;

Col. 7, line 14, delete "=" and substitute therefor --"--;

line 67, before "$x10^{-3}$" insert --5--;

Col. 18, line 9, after "space" insert --,--; and

Col. 20, line 1, before "luminaire" delete "The" and substitute therefor --A--.

Signed and Sealed this

Twenty-seventh Day of November 1979

[SEAL]

Attest:

RUTH C. MASON
Attesting Officer

LUTRELLE F. PARKER
Acting Commissioner of Patents and Trademarks